US009863600B2

(12) United States Patent
Kieslich

(10) Patent No.: US 9,863,600 B2
(45) Date of Patent: Jan. 9, 2018

(54) GALVANICALLY DECORATED DECORATIVE ELEMENT WITH CONTOUR LIGHT

(71) Applicant: Gerhardi Kunststofftechnik GmbH, Luedenscheid (DE)

(72) Inventor: Dirk Kieslich, Plettenberg (DE)

(73) Assignee: Gerhardi Kunststofftechnik GmbH, Luedenscheid (DE)

( * ) Notice: Subject to any disclaimer, the term of this patent is extended or adjusted under 35 U.S.C. 154(b) by 0 days.

(21) Appl. No.: 15/075,721

(22) Filed: Mar. 21, 2016

(65) Prior Publication Data

US 2016/0312974 A1 Oct. 27, 2016

(30) Foreign Application Priority Data

Apr. 22, 2015 (DE) ..... 20 2015 002 993 U
Sep. 7, 2015 (DE) ..... 20 2015 006 175 U
Jan. 15, 2016 (DE) ..... 10 2016 100 629

(51) Int. Cl.

| | |
|---|---|
| ***F21V 3/00*** | (2015.01) |
| ***F21V 3/04*** | (2006.01) |
| ***C25D 5/56*** | (2006.01) |
| ***C25D 7/00*** | (2006.01) |
| ***C25D 5/10*** | (2006.01) |
| ***C25D 5/54*** | (2006.01) |
| *C25D 5/02* | (2006.01) |
| *F21W 121/00* | (2006.01) |
| *F21Y 101/02* | (2006.01) |

(52) U.S. Cl.
CPC ..... *F21V 3/0436* (2013.01); *C25D 5/10* (2013.01); *C25D 5/54* (2013.01); *C25D 5/56* (2013.01); *C25D 7/00* (2013.01); *F21V 3/0445* (2013.01); *C25D 5/02* (2013.01); *F21W 2121/00* (2013.01); *F21Y 2101/02* (2013.01)

(58) Field of Classification Search
USPC ..... 362/311
See application file for complete search history.

(56) References Cited

U.S. PATENT DOCUMENTS

| | | | |
|---|---|---|---|
| 5,935,691 | A | 8/1999 | Tsai |
| 2003/0012968 | A1 | 1/2003 | Phu et al. |
| 2013/0286654 | A1 | 10/2013 | Tamura et al. |
| 2016/0101548 | A1 | 4/2016 | Kieslich |

FOREIGN PATENT DOCUMENTS

| | | | |
|---|---|---|---|
| DE | 195 16 540 | A1 | 2/1997 |
| DE | 197 36 690 | A1 | 2/1999 |
| DE | 198 22 636 | A1 | 11/1999 |
| DE | 199 58 582 | B4 | 8/2006 |
| DE | 10 2006 011 641 | B3 | 7/2007 |
| DE | 10 2006 046 402 | A1 | 4/2008 |
| DE | 20 2007 018 495 | U1 | 9/2008 |
| DE | 20 2008 008 822 | U1 | 11/2008 |

(Continued)

*Primary Examiner* — Matthew Mikels
(74) *Attorney, Agent, or Firm* — Collard & Roe, P.C.

(57) ABSTRACT

A galvanically decorated decorative element with contour light is produced from at least two plastic components in a material-fit composite, wherein a first plastic component is galvanigable and forms the decorative element. At least one second plastic component is galvano-inert. Consequently, it is uncoated and passes through the electroplating process unchanged. It represents a transilluminable contour light region.

7 Claims, 1 Drawing Sheet

(56) References Cited

FOREIGN PATENT DOCUMENTS

| | | | |
|---|---|---|---|
| DE | 10 2008 032 761 | A1 | 2/2009 |
| DE | 20 2008 008 877 | U1 | 2/2009 |
| DE | 102 46 695 | B4 | 4/2009 |
| DE | 10 2008 057 332 | A1 | 5/2010 |
| DE | 10 2011 104 012 | A1 | 2/2012 |
| DE | 10 2011 120 581 | A1 | 6/2013 |
| DE | 10 2010 016 973 | B4 | 1/2014 |
| DE | 10 2012 109 659 | A1 | 4/2014 |
| DE | 10 2012 219 995 | A1 | 4/2014 |
| DE | 10 2013 109 361 | A1 | 3/2015 |
| EP | 1 930 925 | A1 | 6/2008 |
| WO | 2014/173445 | A1 | 10/2014 |

GALVANICALLY DECORATED DECORATIVE ELEMENT WITH CONTOUR LIGHT

CROSS REFERENCE TO RELATED APPLICATIONS

Applicant claims priority under 35 U.S.C. §119 of German Application No. 20 2015 002 993.0 filed Apr. 22, 2015, German Application No. 20 2015 006 175.3 filed Sep. 7, 2015, and German Application No. 10 2016 100 629.7 filed Jan. 15, 2016, the disclosures of which are incorporated by reference.

BACKGROUND OF THE INVENTION

1. Field of the Invention

The invention relates to a galvanically decorated decorative element with contour light, which can be used with an additionally mounted light guide for ambient lighting in door panels, center consoles, and instrument panel trims in vehicles.

2. Description of the Related Art

Decorative elements are known from DE 10 2008 057 332 A1 as well as from DE 198 22 636 A1, which fulfill the desire for decoration with simultaneous transillumination. In this state of the art, the symbol lighting or ambient lighting is implemented by a light source disposed behind the decorative element, which source guides light through a partly or partially light-permeable decoration. The ability of the decorative element to allow transillumination is achieved by means of imprinting or in-mold decoration, "IMD decoration" for short. In this regard, a carrier film with the motif, to be transferred is placed within an open injection-molding mold, wherein the motif has the desired color. In this regard, the motif points in the direction of the opening of the mold tool. While the injection-molding mold is being filled with plastic, the color adheres to the cast parts and is released from the film when the injection-molding mold is opened. The coated part is subsequently removed from the injection-molding mold. In the case of a partial representation, for example a symbol representation, a barrier layer is additionally applied to the rear side. This barrier layer allows light guidance only in the predetermined regions.

The current desire of the automotive industry for contour light lighting on or in galvanized decorative elements, however, is not fulfilled by either of these embodiments.

SUMMARY OF THE INVENTION

The invention is therefore based on the task of making available a galvanically decorated decorative element with contour light, which element has a compact structure, can be produced as a composite, and can be implemented with delicate contour light solutions.

This task is accomplished according to the invention by a galvanically decorated decorative element with contour light which is produced from at least two plastic components in a material-fit composite. A first plastic component is galvanizable and forms the decorative element, and at least one second plastic component is galvano-inert, in other words, the component passes through the electroplating process in uncoated and unchanged manner, and represents the transilluminable contour light region.

With the invention, a galvanically decorated decorative element with contour light is created, which element has a compact structure and can be produced as a composite.

Furthermore, it is possible to create delicate contour light solutions with the decorative element according to the invention. These solutions are brought about by the two plastic components, which are joined together in a material-fit composite to form a component section. The first, galvanizable plastic component represents the decorative element, which does not differ optically from known decorative elements. The second plastic component is not galvanizable, in other words is galvano-inert and consequently passes through the electroplating process in uncoated and unchanged manner. This second plastic component forms the transilluminable region. Therefore components can be produced, which fulfill the desire of the automotive industry for contour light lighting on or in galvanized decorative elements.

It is advantageous if the second plastic component consists of an amorphous plastic such as polyamide (PA), and, in particular, of a polycarbonate (PC), which are adjusted to be transparent, translucent or light-scattering. Components composed of polyamides (PA) or polycarbonates (PC), having the above properties, allow transillumination, so that the desired contour light solutions can be implemented with them.

Preferably, the component section produced from the second plastic component encompasses the transilluminable contour light region as well as a region of the rear side of the component section of the first plastic component. The at least partial enclosure of the component section of the first plastic component improves the adhesion and the bond of the two components. Furthermore, the encompassing has a positive effect on the distortion of the components. In addition, attachment elements such as hooks or engagement elements can be formed from the non-galvanizable component.

In a further embodiment, the contour light region as well as the component region of the decorative element, which region is to be electroplated, are geometrically configured so that during the subsequent electroplating process, the deposited metal layers build up with sharp contours, precisely to the material joint of the two plastic components. In this way, extremely delicate transilluminable contours can be produced in the decorative element. As a result, the design possibilities in the interior design of the vehicles are additionally improved.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figure 1:
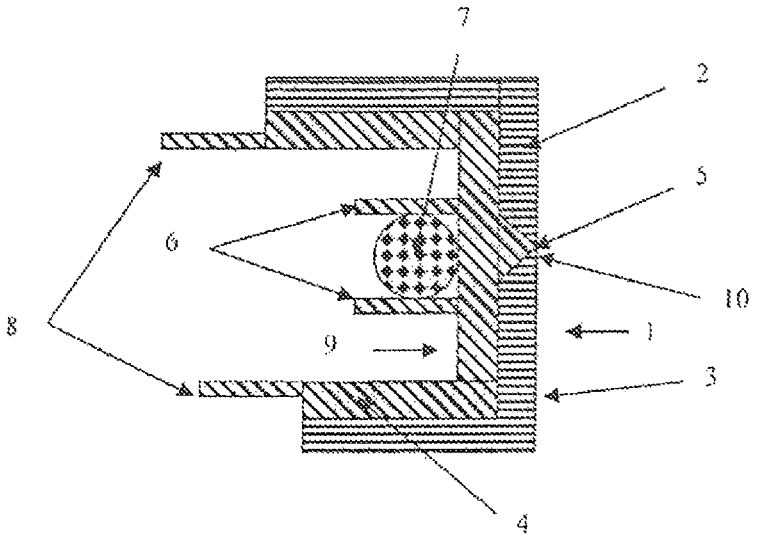
FIG. 1 is a schematic representation of a galvanically decorated decorative element with contour light, in section.

The galvanically decorated decorative element with contour light selected as an exemplary embodiment is produced from at least two plastic components 2, 4, in a material-fit composite. The connection of the two components 2, 4 is consequently held together by means of atomic or molecular forces. The connection is not releasable. It is produced in a two-component injection-molding process. In a modification of the exemplary embodiments described below, the possibility also exists of providing multiple components of both the first and of the second plastic component.

One of the two plastic components 2—called "the first plastic component" hereinafter—is galvanizable. It forms the decorative element 3. In the exemplary embodiment, the first plastic component 2 consists of a copolymerizate that contains butadiene. Other materials can also be used, however, as long as they are galvanizable.

The other plastic, component 4—called "the second plastic component" hereinafter—is galvano-inert. In the sense of the present invention, galvano-inert is understood to mean that the plastic component 4 passes through the electroplating process in uncoated and unchanged manner. Therefore no galvanic precipitates or coatings deposit on the second plastic component 4 during the electroplating process.

The second plastic component 4 represents the transilluminable contour light region 5. In the exemplary embodiment, the second plastic component 4 furthermore encompasses a large region of the rear-side component section of the first plastic component 2. It is evident that in the exemplary embodiment according to FIGS. 1 and 2, the second plastic component 4 forms the entire rear side 9 of the decorative element 3. The second plastic component 4 is composed of an amorphous polyamide (PA), which is transparent, translucent, or light-scattering. Preferably, the plastic component 4 consists of at polycarbonate (PC). Polymethylmethacrylate (PMMA) or cyclo-olefin copolymers (COC), however, can also be used.

A component section is produced from the galvano-inert second plastic component 4, which section makes available an attachment or fixation 6 for an illuminant 7 affixed to the rear side. The illuminant 7 can be light emitting, diodes (LEDs) or light guides. In addition, the component section composed of the second plastic component 4 forms welding tabs 8. Attachment elements can also be used instead of the welding tabs.

In the exemplary embodiment according to FIG. 1, the first, galvanizable plastic component 2 is configured in U shape. In the installed state, it represents the visible part of the decorative element 3. The second plastic component 4 is disposed in the D shape of the first plastic component 2. In the exemplary embodiment according to FIG. 1, the plastic component 4 is also configured in U shape, so that the second plastic component 4 has two shanks that are connected with one another by means of a base oriented at a right angle to the shanks. Welding tabs 8 for attaching the decorative element 3 to the vehicle are provided at the free ends of the shanks. Two fixation elements 6 are disposed on the base of the second plastic component 4, which elements serve for attachment of the illuminant 7, which is a light guide in the exemplary embodiment.

As can be seen in FIG. 1, the base of the second plastic component 4 has an essentially triangular projection that is provided directly adjacent to the illuminant 7. After electroplating of the second plastic component 4, the triangular projection is essentially enclosed by the first plastic component 2. Only a narrow region, above the tip of the triangular projection is not enclosed by the galvanizable plastic component 2, so that a very narrow transilluminable contour light region 5 occurs. This area occurs in the region of the material joint 10 of the two plastic components 2, 4. The material joint 10 is configured so that the galvanic separation is moved into a non-visible region. It is evident that the component section produced from the second plastic component 4 encompasses the transilluminable contour light region 5 as well as the entire rear side 9 of the component section of the first plastic component 2.

Figure 2:
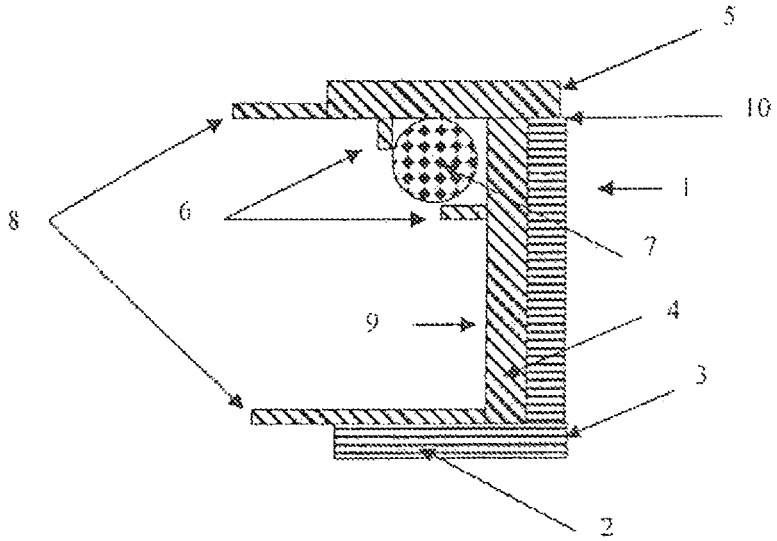
FIG. 2 is a schematic representation of a galvanically decorated decorative element with contour light, in section, in another embodiment.

In the exemplary embodiment according to FIG. 2, the first, galvanizable plastic component 2 forms an L-shaped decorative element 3. The rear side 9 is filled with the second plastic component 4. The second plastic component 4 is essentially U-shaped, which is covered using a projection of the L-shaped plastic component 2. The material joint 10 of the two plastic components 2, 4 is situated in the region of the overlap. The projecting region of the second plastic component 4 that is directed toward the visible side 1 forms the transilluminable contour light region 5 in this exemplary embodiment. In the exemplary embodiment according to FIG. 2, the illuminant 7 is disposed in a corner of the U-shaped second plastic component 4. It is attached there by means of the fixations 6. It is evident that in this exemplary embodiment, as well, the component section produced from the second plastic component 4 encompasses the transilluminable contour light region 5 as well as the entire rear side 9 of the component section of the first plastic component 2. In a modification of the exemplary embodiment, the possibility also exists that the component section produced from the second plastic component 4 merely encompasses the rear side 9 in certain regions.

In the galvanically decorated decorative element according to the invention, the illuminant 7 is disposed on the rear side 9 of the decorative element 3. Placement of the illuminant 7 takes place in the immediate vicinity of the material joint 10 of the two plastic components 2, 4 and thereby in the immediate vicinity of the transilluminable contour light region 5. In the exemplary embodiment according to FIG. 1, the contour light region 5 is provided solely on the visible side 1 of the decorative element 3. In the exemplary embodiment according to FIG. 2, the contour light region 5 is provided not only on the visible side 1 but also to the side of it. The configuration selected in the exemplary embodiment according to FIG. 2 represents the possibility of ambient lighting. In this case, the decorative element 3 can form a strip in a vehicle door or in the instrument panel, for example, in which strip the light is emitted in the direction of the vehicle floor and thereby illuminates the vehicle interior in certain regions. The situation is different in the exemplary embodiment according to FIG. 1, in which the transilluminable contour light region 5 is configured with sharp contours on the visible side. In this way, strips or symbols with an exact contour can be represented.

The production of the galvanically decorated decorative element according to the invention takes place in known manner. First, a connection between the plastic components 2 and 4 is produced using the two-component injection-molding process. Subsequently, electroplating takes place, wherein the galvanic layer is deposited solely on the first, galvanizable plastic component 2. The regions formed by the second, galvano-inert plastic component 4 remain clear, thereby creating the transilluminable region 5. In this regard, the contour light region 5 as well as the component region to be electroplated are geometrically configured in such a manner that the deposited metal layers build up, during the electroplating process, with sharp contours precisely to the material joint 10 of the two plastic components 2, 4. Subsequently, the illuminant 7 is installed in the decorative element 3, thereby completing the decorative element according to the invention.

Although only a few embodiments of the present invention have been shown and described, it is to be understood that many changes and modifications may be made thereunto without departing from the spirit and scope of the invention.

What is claimed is:

1. A galvanically decorated, decorative element with contour light comprising a material-fit composite produced from at least first and second plastic components;

wherein, the first plastic component is galvanizable and forms a decorative element section;

wherein the second plastic component is galvano-inert and passes through an electroplating process uncoated and unchanged;

wherein the second plastic component forms a transilluminable contour light region;

wherein the second plastic component produces a component section comprising attachment elements or welding tabs, attachment and fixation members, and an illuminant affixed to a rear side of the decorative element section by the attachment and fixation members;

wherein a component region of the rear side of the decorative element section of the first plastic component is electroplated with deposited metal layers and wherein the transilluminable contour light region as well as the component region are geometrically configured so that during the electroplating process, the deposited metal layers build up with sharp contours, precisely to a material joint of the first and second plastic components; and wherein the material joint is configured so that galvanic separation is placed into a non-visible region.

2. The galvanically decorated decorative element according to claim 1, wherein the first plastic component comprises a copolymerizate that contains butadiene.

3. The galvanically decorated decorative element according to claim 1, wherein the second plastic component comprises a transparent, translucent or light-scattering amorphous plastic.

4. The galvanically decorated decorative element according to claim 3, wherein the amorphous plastic comprises a polyamide (PA).

5. The galvanically decorated decorative element according to claim 3, wherein the amorphous plastic comprises a polycarbonate (PC).

6. The galvanically decorated decorative element according to claim 1, wherein the illuminant is formed by light emitting diodes (LEDs) or LED-supplied light guides.

7. The galvanically decorated decorative element according to claim 1, wherein the component section produced from the second plastic component encompasses the transilluminable contour light region as well as the component region of the rear side of the decorative element section of the first plastic component.

* * * * *